US005568783A

United States Patent [19]

Ditchfield

[11] Patent Number: 5,568,783

[45] **Date of Patent: * Oct. 29, 1996**

[54] PERSONAL WATER SURFACE TOWING DEVICE

[76] Inventor: Ronald G. Ditchfield, 2, Fairways, Thornbury Road, Isleworth, Middlesex TW7/4NS, England

[ * ] Notice: The term of this patent shall not extend beyond the expiration date of Pat. No. 5,388,543.

[21] Appl. No.: 386,506

[22] Filed: Feb. 10, 1995

Related U.S. Application Data

[63] Continuation of Ser. No. 105,684, Aug. 13, 1993, Pat. No. 5,388,543.

[30] Foreign Application Priority Data

Sep. 1, 1992 [GB] United Kingdom ..... 9309131

[51] Int. Cl.[6] ..... B63B 21/56

[52] U.S. Cl. ..... 114/242; 114/315

[58] Field of Search ..... 114/312, 315, 114/242; 441/65

[56] References Cited

U.S. PATENT DOCUMENTS

| | | | |
|---|---|---|---|
| 3,584,594 | 6/1971 | Poutout | 14/315 |
| 3,890,920 | 6/1975 | Buelk | 114/315 |
| 5,158,034 | 10/1992 | Hsu | 114/315 |
| 5,388,543 | 2/1995 | Ditchfield | 114/242 |

FOREIGN PATENT DOCUMENTS

| | | | |
|---|---|---|---|
| 1522520 | 4/1968 | France | 114/315 |
| 518819 | 3/1955 | Italy | 114/315 |
| 47394 | 4/1981 | Japan | 114/315 |

*Primary Examiner*—Jesus D. Sotelo

[57] ABSTRACT

A self powered or externally powered recreational and therapeutic aquatic device that will tow a person through and across a water surface, where in use, most of the persons body is essentially in the water, but where the head and arms are supported above the surface in a manner that could be described as a powered alternative to swimming but with a higher speed capability. The towing device and the person form an essentially single combined hydrodynamically streamlined shape that diverts or guides surrounding water underneath or around the persons chest area in a smooth flow. Steering is executed with the upper arms or shoulders, instead of the hands, and a variable stretching or extending force is applied to the persons torso and spine, controlled by the person.

16 Claims, 3 Drawing Sheets

Fig.3
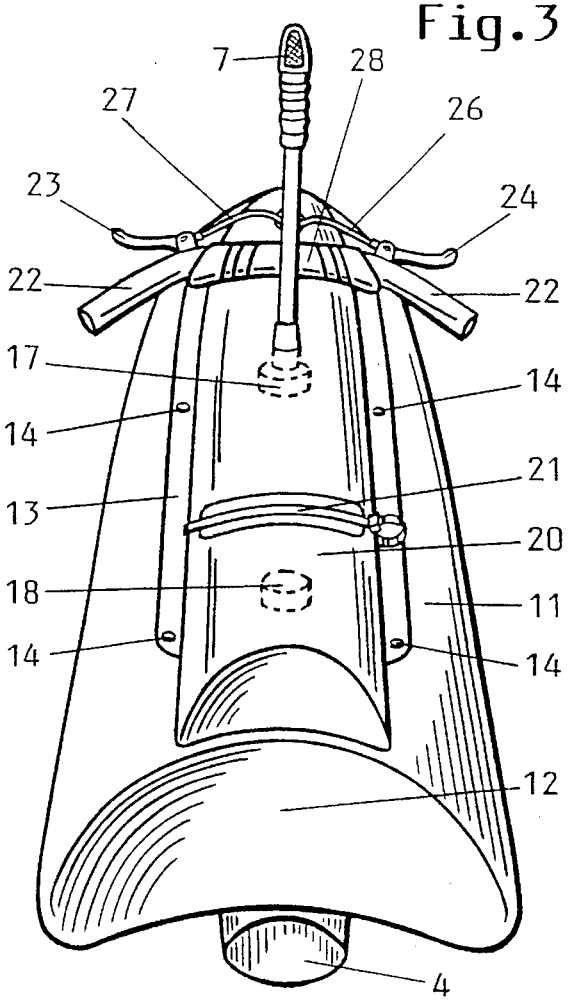
Fig.4
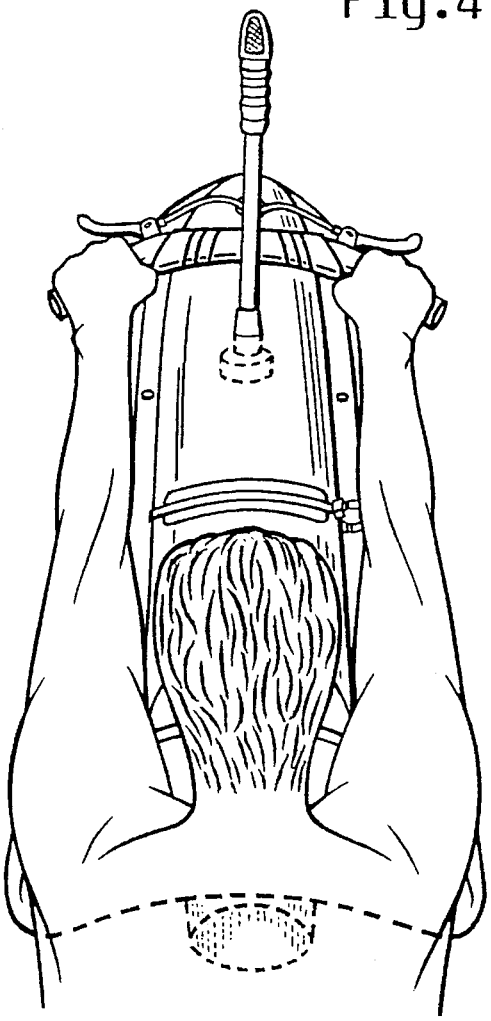
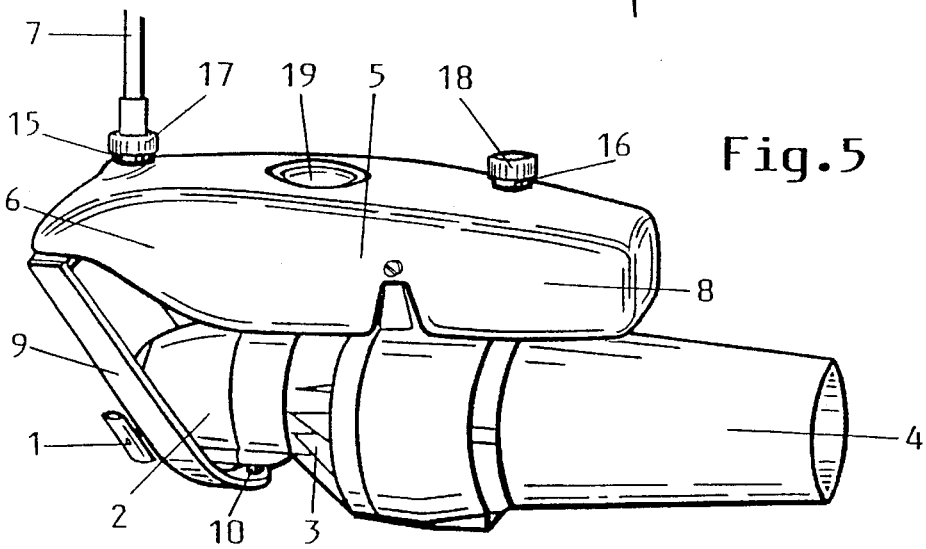
Fig.5

Fig.6
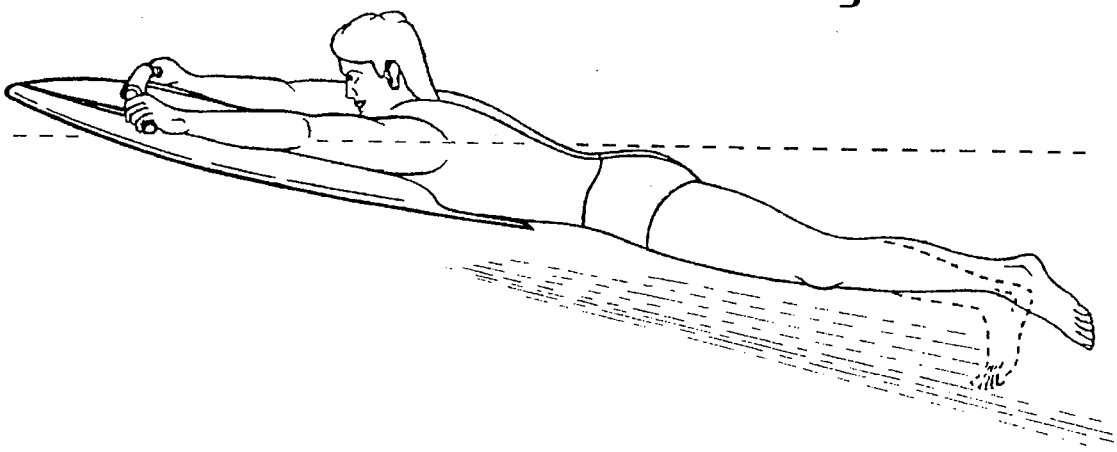
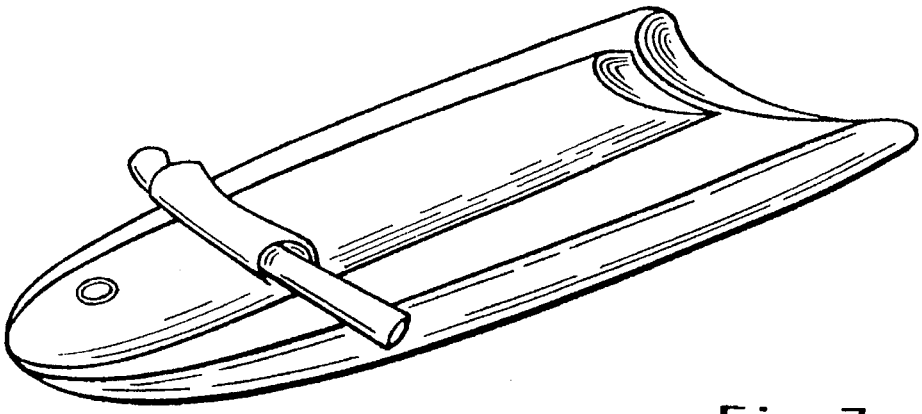
Fig.7

PERSONAL WATER SURFACE TOWING DEVICE

REFERENCES TO RELATED APPLICATIONS

This application is a Continuation of the application of Ronald G. Ditchfield, Ser. No. 08/105,684., filed Aug. 13th, 1993., titled Personal Water Surface Towing Device., now U.S. Pat. No. 5,388,543 issued Feb. 14th, 1995.

BACKGROUND AND PRIOR ART

This invention relates boa recreational and therapeutic aquatic device that will tow a person through and across a water surface where in use most of the persons body is essentially in the water below the surface, but where the head and arms are supported above the surface, in a manner that could be described as an alternative to swimming but with a higher speed capability. The towing device is either self powered or powered externally, such as being bowed by a boat or other external means.

There are many varied vehicles or products designed for use on water, recreational or otherwise, ranging from various types of boats, powered sailing or rowing, to products towed by boats such as water skis, towable inflatable products and the like. Various other products powered or not, such as jet skis, surfboards, pedaloes, canoes, windsurfing boards etc. All these products are designed to essentially carry and propel someone over and across a water surface. There are even products that still essentially carry and propel a person, although the person is in contact with the water or partially submerged, such as U.S. Pat. Nos. 3,543,712 or 3,716,013, or British specification 795194 or P.C.T. publication WO 84101755.

As opposed to this concept of being carried and propelled over and across water, there are few products that actually tow a persons body itself directly in and through a water surface.

The few products designed to tow, known to be exhibited by prior art take various forms, all self powered, since the primary or only purpose of the known prior art is to propel a person along independently. The inventive concept of the present invention adds an additional reason or use for the existance of an externally powered towing device. This will become clearer, later, in the explanation of the advantages of the present invention. Some of these various forms of prior art are, a power unit attached to a framework and held above the water by a float or floats, towing a person behind (French No 2625684), a power unit enclosed in a boat shaped box or hull, with a means of holding on (Japanese No 2-126870 or British specification 1545222), or a device which is commercially available, a specially designed water sealed internal combustion engine operating direct in water, again with a means of holding on (U.S. Pat. Nos. 3,630,165 or 3,890,920). Generally, the majority and the earlier of prior art had the means of holding and controlling positioned at the rear of the device. This was a very tiring and sluggish means of steering. Later on it was found that positioning the means of holding and controlling at the front of the towing device (U.S. Pat. No. 3,890,920) was less tiring and a lot more accurate, despite the fact that with this system it is necessary to control whether the device is tilted in an upwards or downwards direction as well as steering from side to side. Although these and other designs are different from each other, the basic overall concept of all prior art has been a separate towing device, towing a person along as a separate entity. Although an acceptable arrangement at normal swimming speeds, little or no consideration seems to have been given to the potential or possible capabilities of a towing device beyond simply motorising a swimmer, and in fact above normal swimming speeds, the arrangement is inherently hydrodynamically inefficient to the point of being self limiting, both in terms of performance or speed attainable, and also in the level of energy required from the user for the following reasons.

It is a well known and accepted fact that if a human body lying face down is moved forwards through water with the arms outstretched and the head raised above the water surface, most drag or turbulence in the water will occur around the persons upper chest and shoulders, caused by the relatively blunt shape of the persons frontal chest area and shoulders trying to push through the water. This is the reason why even at speeds as low as normal swimming, all professional and any serious swimmer will swim with their head down in an attempt to overcome this drag effect, only raising it momentarily in order to see and breathe.

Where a towing device is towing a person along as a separate entity, the necessity of the person being towed holding on to the device and consequently having their arms and chest submerged in the water while their head is raised and tilted upwards in order to see and breathe creates if any speed is involved, considerable drag or turbulence in the form of a "bow wave" around the upper chest and shoulders for the reasons already explained. As speed is increased, the "bow wave" becomes more pronounced and higher, having the effect of trying to drag the person being towed away from the device, tiring the persons arms in the process and causing the person to attempt to hold their head higher which creates an even more pronounced and higher "bow wave", the only solution being to reduce speed.

All prior art where the only contact between the device and the person being towed is the persons hands holding on to the device, is inevitably tiring in use since any steering or directing, not just left or right but on some devices up or down as well, in order to maintain a desired driving angle or distance from the device, can only be accomplished by using the strength of their hands, wrists or arms.

A related effect which also causes tiring is that in normal sea conditions where waves exist, the level of the towing device bobbing up and down and that of the person being towed is constantly changing in relation to each other. In choppy water conditions, these changing levels can also mean that the persons body can inadvertently partially block or get in the way of the propelling stream of water.

Finally, with prior art, the person's head is not positively supported above the water surface. In conditions not anticipated, such as rough sea, cramp, illness, fatigue, sickness or injury, the person must still make the relevant effort to hold their head above water.

In conclusion, although some are better than others, at any speed significantly above normal swimming speeds, all prior art requires considerably more energy and effort than necessary from the user, in order to steer or control, and to overcome the drag or turbulence around the person's chest area, in achieving what can only be a comparatively modest increase in speed before the self limiting effect inherent in the concept of a separate towing device and a separate user takes over.

OBJECTS AND SUMMARY OF THE INVENTION

In the following description of the present invention, it will be seen that the disadvantages mentioned of prior art have been overcome, and it is believed a unique benefit added, which is equally applicable to an externally powered towing device as a self powered device. This has been achieved by adopting an essentially different concept, which is to regard the towing device and the person being towed as a single overall hydrodynamically streamlined entity.

This concept was arrived at by considering the basic example mentioned earlier of a human body lying prone in water with the arms outstretched in a substantially parallel manner and the head raised above the water surface and the best way to streamline it. The ultimate example of hydro dynamic streamlining considered was a dolphinlike shape. Accordingly, the principal object of the present invention is to go beyond simply motorising a swimmer at normal swimming speeds and emulate as far as possible the streamlining and effortless manner in which a dolphin moves and manoeuvres through water and to impart to the user of the towing device its sense of freedom, albeit only on the water surface.

For the sense of freedom, it is an important feature of the present invention that most of the persons body, substantially from the chest down, is essentially in the water unencumbered by contact with the towing device but in a manner still consistent with efficient streamlining. This is accomplished by supporting the outstretched arms on a hydrodynamically streamlined buoyant body that fills in or spans the space between the arms, going some way in front beyond the hands to be able to incorporate a narrowed streamlined nose, and continuing a streamlined shape rearwards on the under surface to skim the water, and shaping the rear end of the device to merge and blend hydrodynamically with the chest area of the user. Since the buoyancy of the towing device is higher than the person being towed, this area of merging and blending is held a close fie by the buoyancy of the device pushing upwards and the body weight of the person pushing downwards. The overall effect of combining the towing device and user in this manner produced the desired result of a single overall hydrodynamically streamlined shape that diverts or guides water underneath or around the users chest area in a smooth flow. It was also decided that any substantial weight including the motor or power means and propulsion means, should be underslung beneath the device body and water surface for maximum stability and so that the deck of the towing device could be substantially flat and clear of obstructions for good visibility. The towing device body was kept the same or similar width as the user partly for hydrodynamic reasons, but also so that the towing device would roll easily, with a self levelling effect caused by the underslung weight, so that manoeuvring or steering would simply be a matter of leaning or applying body weight with the upper arms and shoulders to the relevant side, with very little conscious effort required.

Consequently, according to the present invention there is provided, a buoyant water surface towing device adapted to tow a person through and across a water surface, normally by the hands, with their outstretched arms lying on top of and in contact with its top surface deck comprising, a body having a lower underside surface that is a hydrodynamically streamlined hull and a top surface deck for the persons fully extended arms to lie on. There is an area continuing rearwards from the rear end of the top surface deck that is adapted and shaped to blend and merge hydrodynamically with the persons these area, such as by meeting up against it in a compatible mating manner with an arcuately dished area sloping downwards and rearwards from the top surface deck to the rear end of the underside surface. There is a means for holding with the hands the towing device such as handlebars and also control levers if the device is self powered, positioned forwards from the rear end, along the top surface deck, so that its placement relative to the top surface deck, is a means where when the towing device is in use the persons arms can be fully extended, positioned over and supported on top of the top surface deck with their chest accommodated against the means at the rear end of the top surface deck so that most of their body from substantially the chest down is essentially in the surrounding water unencumbered by contact with the towing device, so that if the attachment means between the towing device and person is released they will readily separate. An optional feature, is to have a protective extension apron extending from the rear lower extremity of the area that is shaped to accommodate the persons chest area, to cover the persons frontal area below the chest. The self powered device has a motive power means being an internal combustion engine, electric motor or other means, driving a propulsion means which expels at least one water jet rearwards to drive the towing device forwards.

All the various criteria has been met and the objects of hydrodynamic streamlining, effortless manoeuvring and a sense of freedom achieved, and it is believed, the present invention is a significant advance over the prior art.

DESCRIPTION OF THE DRAWINGS

FIG. 3 shows a top view of the water surface towing device viewed from the rear, illustrating the arcuately dished rear end shape.

FIG. 4 is the same illustration as FIG. 3, but with a person in the normal operating position to illustrate the dimensional relationship between the two.

FIG. 5 is a side view of the self contained engine unit.

FIG. 6 is a side view of an externally powered towing device for towing by an external means and incorporating an extension apron to cover and protect the persons frontal area below the chest.

FIG. 7 is a perspective view of an alternative example of an externally powered device.

DESCRIPTION OF THE INVENTION

Figure 1:
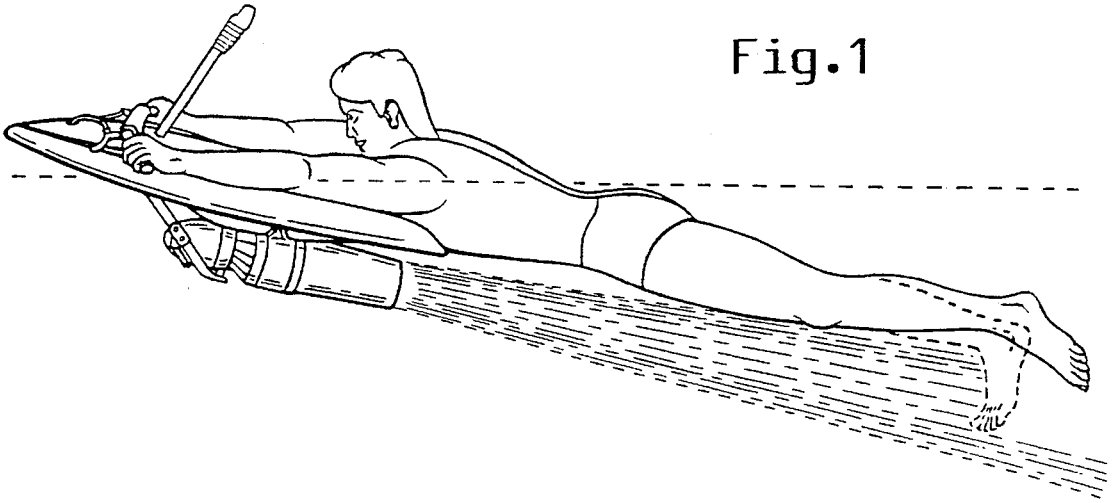
FIG. 1 is a side view of the water surface towing device and a person holding the device in the normal operating position with a typical water level while stationary, indicated by the horizontal dotted line, and the path of the propelling water jet, with the persons feet in the normal trailing position and also angled downwards to increase water drag on their lower body.
Figure 2:
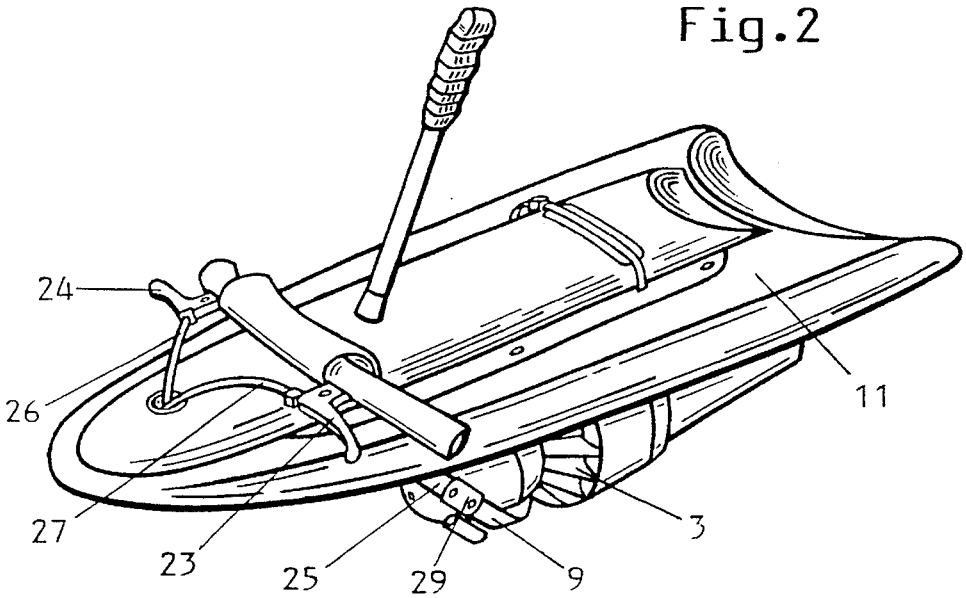
FIG. 2 illustrates in perspective the water surface towing device.

This particular example is intended as a light, quickly detachable, easily transportable interpretation of the basic concept, comprising three main component parts. A self contained engine unit, a main body assembly and a handle bar and control lever assembly.

Referring to FIG. 5, the self contained engine unit is a single cylinder internal combustion engine with a recoil starter 1 and a magneto 2 of orthodox design facing forwards and an enclosed propeller (not shown) mounted on the mainshaft facing rearwards, drawing in water at the front 3 and expelling a water jet rearwards through a tunnel 4. The engine unit includes and is attached to a one piece molded plastic tank 5 that incorporates an air tank 6 with a snorkel 7 at the front, through which the carburetor breathes, and a separate fuel tank 8 at the back. Access to the spark plug 19 is through a hole molded in the center of the tank 5. The engine unit also includes a cradle 9, that attaches the front of the tank 5 to engine mounts located at the bottom of the crankcase magneto housing 10. This engine unit is of the type fully described in U.S. Pat. No. 3,890,920 and any further description is thought not to be necessary.

Referring to the drawings, the main body 11 is a hydrodynamically streamlined component manufactured from a plastic foam which is light, durable, possesses a high degree of buoyancy, is rigid enough to maintain its shape, but is comfortable in use and energy absorbing in the event of a collision. It is one metre long, 0.4 metre wide at the rear, narrowing towards the front with a rounded streamlined nose. The rear is chamfered and dished in shape 12 to merge and blend with the upper chest area of the person being propelled. There is a large hole (not shown) aproximately in the middle, shaped to be a close fit over and around the fuel/air tank 5 of the engine unit. There is a top plate 13 manufactured from rigid plastic sheet fixed to the top of the main body 11 with four nylon screw type fixings 14. The top plate has two holes (not shown), one that locates around the air tank threaded top 15 and the other that locates around the fuel tank threaded top 16. Screwing down the snorkel air tank cap 17, and the fuel tank cap 18, fixes the top plate 13 and therefore the main body 11, to the fuel/air tank 5 of the engine unit. There is a larger hole (not shown) in the top plate 13 between the other two, that gives access to the engine units spark plug 19. To complete the main body assembly, there is a top pad 20 made from the same material as the main body 11, which acts as a spacer between the main body and the handle bar assembly, covers the snorkel cap 17, the spark plug access hole, and the fuel cap 18. It also adds extra buoyancy and provides a comfortable chin or head support for the person being towed. There is a nylon securing strap 21, that wraps under the fuel tank 8, goes right through the main body 11 and top plate 13 and buckles over and retains the top pad 20.

The handlebar assembly consists of a set of handlebars 22, a control lever on each end 23 and 24, a support bracket on either side 25, a decorative central cover 28 and a control cable 26 and 27 from each control lever. The support brackets are fixed to the handlebars at a slightly greater width than the width of the main body top pad 20. The handlebar assembly is fitted to the towing device by pushing each support bracket 25 through a hole (not shown) in the forward end of the main body top plate 13, one on either side of the top pad 20, right through the main body 11, and sliding them into a spring loaded retaining clip 29 screwed and fixed on each side of the engine unit cradle 9. The right hand control lever 24 and its control cable 26, are connected to the accelerator lever on the carburetor. The left hand control lever 23 and its control cable 27, is a safety device that in the event of the person being towed, inadvertently letting go of the towing device, would either cause the towing device to go round in a continuous circling motion, or alternatively would stop the engine. The preferred method would be to have the lever and cable connected to a spring loaded rudder (not shown) so that when the lever is pulled right back to the handlebar, the rudder would be in a straight line with the towing device, and if the lever was accidentally released, the rudder would spring to one side out of line causing the towing device to move in a continuous circle until retrieved by the user.

ADVANTAGES OF THE INVENTION

The advantages of the present invention over prior art can now be seen to be, number 1, the drag factor and self limiting effect caused by the persons arms, shoulders and chest being in the water has been overcome.

Number 2, with the present inventions single entity concept, its closeness and overlapping with the person being towed is such that steering is executed with the shoulders or upper arms, not the hands, by leaning or applying body weight to the relevant side of the rear end of the towing device. The "handlebars" are in a fixed position and their function is simply a means of holding the towing device, and operating the control levers. It has been found in fact that in use the hands wrists and arms can be relaxed completely, consistent with the fingers remaining curled around the handlebars. Therefore the tiring effect with prior art of having to steer and direct continuously with hand, wrist or arm pressure has also been overcome.

Number 3, the related tiring effect in rough water conditions, or water conditions where waves exist, of the level of the towing device and the level of the person constantly changing in relation to each other is substantially reduced since the hands, arms, shoulders, chest and head of the person being towed and the said towing device, move up and down together, either up together or down together.

Number 4, where with prior art, the head is not positively supported above the water surface, with the present invention, when the person is holding the handlebars or means of holding in the normal operating position, even if the person is incapacitated or semi-conscious for any reason, their head would still be positively supported above the water surface, both with the towing device moving or stationary.

Number 5, The unique benefit believed to be added, mentioned earlier, which could be the present inventions most important advantage, which is equally applicable to a self powered device or an externally powered device is a variable stretching or extending force applied to the torso and spine of the person being towed. This is caused by the propulsion force of the towing device pulling the hands, arms, and shoulders of the person in a forward direction, the lack of, or neutrality of water drag around their chest area, so that the force of the water drag pulling rearwards on their lower body, at least from the waist down, caused by the surrounding water or propelling water jet, is substantially greater than any water drag on their upper body. The force of the water drag on their lower body can be increased or decreased simply by varying the speed of the towing device or the angle and position of their feet in relation to the surrounding water or propelling water jet, instead of just letting them trail in line. Coupled with the degree of relaxation and infinitely variable movement possible in water, either from steering from side to side or the movement up and down created by waves, the overall effect has been found to be of significant benefit in reducing back pain in a person who suffers with this condition.

In conclusion, the present invention provides a water surface towing device that is not limited by poor hydrodynamic efficiency, and therefore has the capability to travel considerably faster than prior art in a smooth relaxed manner, with significantly less physical effort required and since the head is always supported, with a high degree of safety. It is fun to use, and should prove to be a valuable therapeutic aid.

It should be noted that the basic and essential concept of the present invention of regarding the towing device and the person being towed as a single entity for hydrodynamic purposes, is capable of interpretation in various ways, including different body shapes, constructions,materials, means of powering, means of holding and ranging from sophisticated permanently assembled examples to relatively simple, light, quickly detachable, easily trasportable examples. Therefore, while a relatively simple, quickly detachable example has been illustrated herein, it is appropriate that the appended claims be construed broadly and in a manner consistent with the spirit and scope of the invention herein.

What is claimed is:

1. A buoyant water surface towing device for towing a person through and across a water surface comprising;

a body having a lower underside surface that is a hydrodynamically streamlined hull and a top surface deck that is a moans to solely, contact and support said person, substantially said persons outstretched arms only, said outstretched arms lying along and on top of said deck;

a means at to rear end of said body, continuous from the rear end of said top surface deck, being an area adapted and appropriately shaped to moot and abut up against said persons chest area in a compatible meting mannor;

a means for holding with the hands said towing device, positioned at the front portion of said towing device, and at least partly above said top surface dock; and so that the placement of said means of holding relative to said top surface deck and said means at the rear end of said body, is a means whereby in use of said towing device, said persons arms can be fully extended, lying positioned over and on top of said top surface deck, with said persons chest area accommodated against said means at the rear end of said body, so that most of said persons body from substantially the chest down is essentially in the surrounding water.

2. A buoyant water surface towing device is claimed in claim 1, wherein there is provided a motive power means and a propulsion means, said motive power means driving said propulsion means.

3. A buoyant water surface towing device as claimed in claim 2, wherein said motive power means and said propulsion means are both fixedly suspended underneath and at substantially exterior of said towing device body, immersed in the surrounding water.

4. A buoyant water surface towing device as claimed in claim 3, wherein said motive power means is an internal combustion engine.

5. A buoyant water surface towing device as claimed in claim 4, wherein said motive power means and said propulsion means forms part of a self contained engine unit and said self contained engine unit is separably connected to said towing device body.

6. A buoyant water surface towing device as claimed in claim 5, wherein said separably towing device body (11) is attached to said self contained engine unit by said towing device body having a rigid top plate (13) with two holes that locate respectively around a forward positioned threaded top (15) and a rearwardly positioned threaded top (16), both threaded tops integral with said self contained engine unit and screwing down on each threaded top a threaded cap (17 & 18).

7. A buoyant water surface towing device as claimed in claim 3, wherein said propulsion means expels at least one water jet.

8. A buoyant water surface towing device as claimed in claim 2, wherein said motive power means is an electric motor.

9. A buoyant water surface towing device as claimed in claim 1, wherein said means at the rear end of said body adapted and appropriately shaped to meet and abut up against said persons chest area in a compatible mating mannor, is an arcuately dished area sloping downwards and rearwards relative to said top surface deck, from substantially the rear end of said top surface deck to substantially the rear end of said lower underside surface of said towing device body.

10. A buoyant water surface towing device as claimed in claim 1, wherein said means for holding with the hands said towing device, is a handlebar means comprising a left hand grip and a right hand grip.

11. A buoyant water surface towing device as claimed in claim 1, wherein said towing device facilitating in use of said towing device, that said persons arms can be fully extended, lying positioned over and on top of said top surface deck, is a means whereby steering can be executed by said person loaning and applying weight to either one side or the other of said lop surface deck with the relevant arm and shoulder.

12. A buoyant water surface towing device as claimed in claim 1, whereby said towing device facilitating in use of said towing device, that said persons arms can be fully extended, lying positioned over and on top of said top surface deck, together with said persons chest area accommodated against said means at the rear end of said body so that said person and said towing device blend and merge hydrodynamically, thereby determining a lack of water drag on said persons upper body and chest area, with most of said persons body from substantially the chest down in to surrounding body water, is a means whereby an extension force is applied to the skeletal joints of said person, of at least their shoulder and spinal joints, by water drag on said persons lower body at least from the waist down pulling rearwards in opposition to the propulsion force of said towing device, acting through said means of holding, pulling said persons arms in a forward direction.

13. A buoyant water surface towing device as claimed in claim 1, wherein said towing device tows said person by their hands.

14. A buoyant water surface towing device as claimed in claim 1, whereby if the means of attachment between said towing device and said person to released, said towing device and said person will readily separate.

15. A buoyant water surface towing device as claimed in claim 1, wherein said towing device body is widest at its rear portion and progresses without any substantial lateral projections to a narrower front end.

16. A buoyant water surface towing device as claimed in claim 1, wherein there is provided an extension apron extending from the rear lower extremity of said means at the rear end of said body to cover said persons frontal body area below the chest.

* * * * *